US008264413B2

(12) United States Patent
Huang et al.

(10) Patent No.: US 8,264,413 B2
(45) Date of Patent: Sep. 11, 2012

(54) SINGLE BAND ANTENNA AND ANTENNA MODULE

(75) Inventors: Chih-Yung Huang, Taichung County (TW); Kuo-Chang Lo, Miaoli County (TW)

(73) Assignee: Arcadyan Technology Corporation, Hsinchu (TW)

( * ) Notice: Subject to any disclaimer, the term of this patent is extended or adjusted under 35 U.S.C. 154(b) by 309 days.

(21) Appl. No.: 12/649,045

(22) Filed: Dec. 29, 2009

(65) Prior Publication Data

US 2010/0164830 A1 Jul. 1, 2010

(30) Foreign Application Priority Data

Dec. 30, 2008 (TW) ..... 97151468 A

(51) Int. Cl.
*H01Q 1/24* (2006.01)
*H01Q 1/48* (2006.01)

(52) U.S. Cl. ..... 343/702; 343/846

(58) Field of Classification Search ..... 343/700 MS, 343/702, 846
See application file for complete search history.

(56) References Cited

U.S. PATENT DOCUMENTS

| | | | | |
|---|---|---|---|---|
| 6,639,564 | B2 * | 10/2003 | Johnson | 343/702 |
| 6,894,647 | B2 * | 5/2005 | Jenwatanavet | 343/700 MS |
| 7,109,923 | B2 * | 9/2006 | Ollikainen et al. | 343/700 MS |
| 7,218,282 | B2 * | 5/2007 | Humpfer et al. | 343/700 MS |
| 2007/0229366 | A1 | 10/2007 | Kim et al. | |
| 2007/0279312 | A1 | 12/2007 | Mei et al. | |

FOREIGN PATENT DOCUMENTS

| | | | |
|---|---|---|---|
| CN | 2840343 | Y | 11/2006 |
| TW | M255527 | U | 1/2005 |

* cited by examiner

*Primary Examiner* — Jacob Y Choi
*Assistant Examiner* — Robert Karacsony
(74) *Attorney, Agent, or Firm* — Muncy, Geissler, Olds & Lowe, PLLC

(57) ABSTRACT

A single band antenna includes a radiating part, a feeding part and a grounding part. The feeding part is connected with the radiating part. A first separating slot exists between the radiating part and the feeding part. The grounding part is connected with the feeding part. A second separating slot exists between the feeding part and the grounding part. Each of the first separating slot and second separating slot has at least one bend.

19 Claims, 5 Drawing Sheets

SINGLE BAND ANTENNA AND ANTENNA MODULE

CROSS REFERENCE TO RELATED APPLICATIONS

This Non-provisional application claims priority under 35 U.S.C. §119(a) on Patent Application No(s). 097151468 filed in Taiwan, Republic of China on Dec. 30, 2008, the entire contents of which are hereby incorporated by reference.

BACKGROUND OF THE INVENTION

1. Field of Invention

The present invention relates to a single band antenna and an antenna module.

2. Related Art

Antenna is an important element for transmitting and receiving wireless signals in the wireless products. Without it, the wireless products cannot communicate properly. Therefore, the antenna plays an essential role in wireless communication.

The rapid development of wireless communication brings various types of products and technologies applying multi-band transmission, such that many new products have functions of wireless communication so to meet consumer's demands. The current product demands are not only the basic functions but also additional functions such as GPS, Bluetooth communication, and Mobile Internet. These additional functions need to be implemented with hardware elements and the increasing number of such elements will take more space in the small-sized products. This decreases the space for the antenna in the product.

Because there are various kinds of single band antennas, an inverted-F antenna is used as an example. FIG. 1 shows a conventional inverted-F antenna 1. With reference to FIG. 1, the conventional inverted-F antenna 1 includes a radiating part 11, a feeding part 12, a grounding part 13 and an impedance matching part 14. The radiating part 11 connects the feeding part 12 with the impedance matching part 14 and the impedance matching part 14 is connected to the grounding part 13, such that the inverted-F antenna 1 is formed.

The operation of the inverted-F antenna 1 is described as follows. The signal is fed into the antenna from the feeding part 12 and generates resonance along the feeding part 12 and radiating part 11. The operating frequency band of the inverted-F antenna 1 is determined by the length of the signal resonant path from feeding part 12 to radiating part 11, and the properties of the inverted-F antenna 1 may be adjusted by the impedance matching part 14. The inverted-F antenna 1 is operated at 2.4 GHz for example, and the length L01 needs at least 45 mm to reach the required frequency band. When the operating frequency band of the inverted-F antenna 1 becomes lower, the length of the radiating part 11 has to be longer, such that the antenna takes more space and is difficult to use in the small-sized electronic products.

Thus, it is an important subject for the present invention to provide a single band antenna and an antenna module that the path for signal oscillation is extended and the size of the antenna can be effectively reduced, such that the single band antenna and the antenna module can be applied on various kinds of small-sized electronic devices.

SUMMARY OF THE INVENTION

In view of foregoing, the present invention is to provide a single band antenna and an antenna module, in which the path for signal oscillation can be extended and the size of the antenna can be effectively reduced.

To achieve the above, the present invention is to provide a single band antenna including a radiating part, a feeding part and a grounding part. The feeding part is connected to the radiating part and a first separating slot is between the radiating part and the feeding part. The grounding part is connected to the feeding part and a second separating slot is between the feeding part and the grounding part. Each of the first separating slot and second separating slot has at least one bend.

To achieve the above, the present invention is to provide an antenna module including a substrate and a single band antenna. The single band antenna is disposed on the substrate and includes a radiating part, a feeding part and a grounding part. The feeding part is connected to the radiating part and a first separating slot is between the radiating part and the feeding part. The grounding part is connected to the feeding part and a second separating slot is between the feeding part and the grounding part. Each of the first separating slot and second separating slot has at least one bend.

As mentioned above, the single band antenna and the antenna module of the present invention is to connect the radiating part, the feeding part and the grounding part to one another and separate these parts with the first separating slot and the second separating slot. Each of the first separating slot and second separating slot has at least a bend, which can extend the path for signal oscillation and effectively reduce the size of the antenna, such that the antenna may be used on the small-sized electronic products.

As mentioned above, the single band antenna and the antenna module of the present invention can be operated in different frequency bands by adjusting the length of the radiating part. In addition, the single band antenna and the antenna module of the present invention further include an electrical structure connecting part. The operating frequency band of the single band antenna and antenna module may be adjusted by changing the size of the electrical structure connecting part so as to improve the impedance matching of the single band antenna.

According to above, the feeding part and the grounding part of the single band antenna and antenna module according to the present invention further include a connecting structure, which can easily fix the single band antenna on a substrate.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
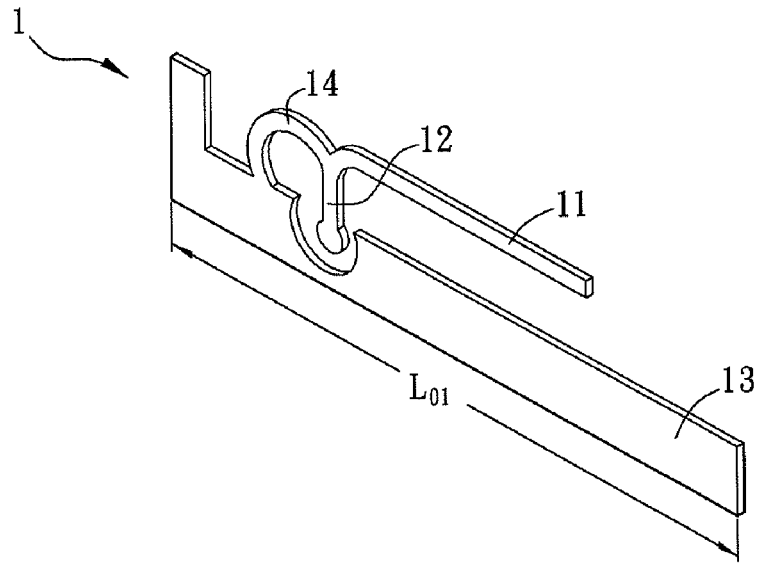
FIG. 1 (Prior Art)
FIG. 1 is a schematic view of a conventional inverted F-antenna.
Figure 2:
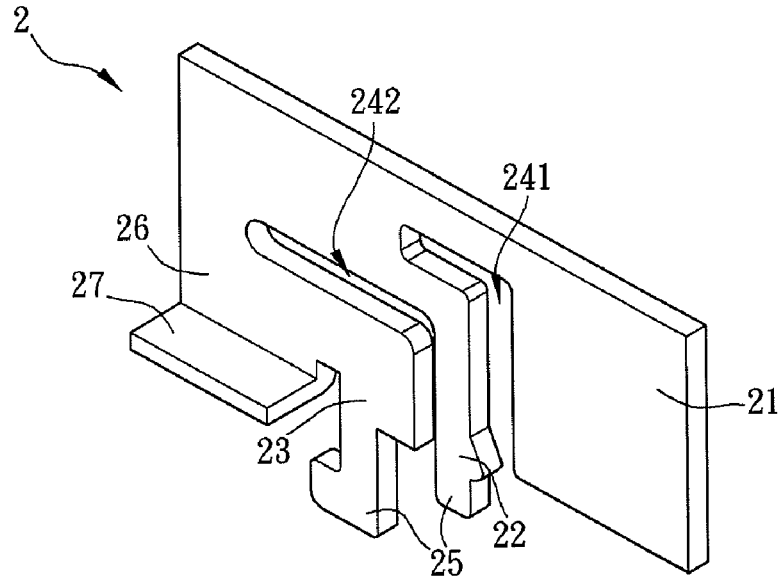
FIG. 2 is a schematic view of a single band antenna according to a preferred embodiment of the present invention.

FIG. 2 is a schematic view of a single band antenna according to a preferred embodiment of the present invention. The single band antenna 2 includes a radiating part 21, a feeding part 22, and a grounding part 23.

The radiating part 21 is connected to the feeding part 22 and a first separating slot 241 is between the radiating part 21 and the feeding part 22. The feeding part 22 is connected to the grounding part 23 and a second separating slot 242 is between the feeding part 22 and the grounding part 23. Each of the first separating slot 241 and the second separating slot 242 has at least on bend. After the signal is fed from the feeding part 22, the signal will resonate on the antenna along the path from the feeding part 22 to the radiating part 21. Since the first separating slot 241 has a bend, the path for signal resonance is extended as well. Thus, the part of the feeding part 22 corresponding to the first separating slot 241 may be seen as a resonance path extending part, such that the single band antenna 2 in the embodiment can have a longer resonance path among the antennas with the same area size.

In the embodiment, the single band antenna 2 may be operated in a different frequency band by adjusting the length of the radiating part 21 to extend in the opposition direction from the first separating slot 241. For example, it may be used in the frequency band such as digital enhanced cordless telecommunications (DECT, 1880 MHZ to 1900 MHz) or WiFi (2400 MHZ to 2500 MHz). Furthermore, in the embodiment, sizes, lengths, or bending directions of the first separating slot 241 and second separating slot 242 may or may not be the same.

In the embodiment, the feeding part 22 and the grounding part 23 may have a connecting structure 25, respectively, such that the single band antenna 2 can be easily connected to a substrate.

In addition, in the embodiment, the single band antenna 2 further includes an electrical structure connecting part 26 and an auxiliary part 27. The electrical structure connecting part 26 is disposed between the grounding part 23 and the feeding part 22, and the auxiliary part 27 is connected with the electrical structure connecting part 26. Moreover, the size of the electrical structure connecting part 26 can be adjusted to expand the operating frequency band of the single antenna so as to improve the impedance matching of the single band antenna.

Figure 3:
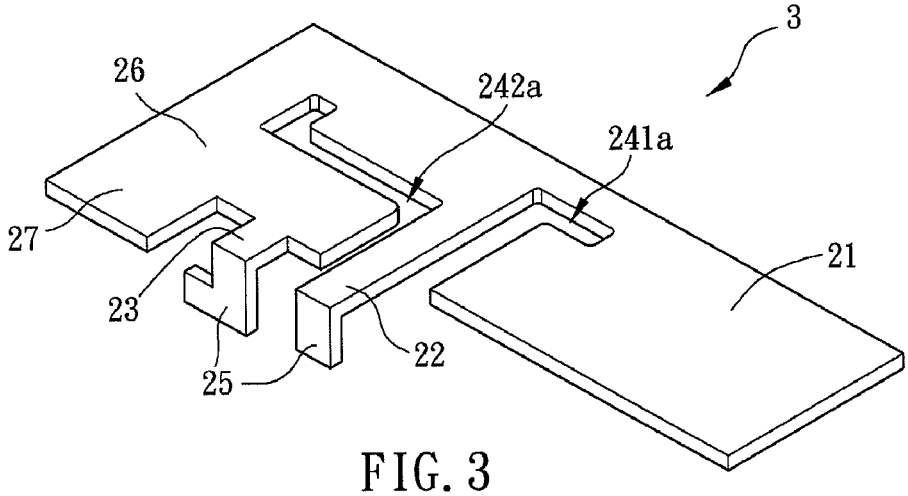
FIG. 3 is another schematic view of the single band antenna according to the preferred embodiment of the present invention.

With reference to FIG. 3, in different aspects, the inner angle between the auxiliary part 27 and the electrical structure connecting part 26 of the single band antenna 3 according to the present invention may be 180 degrees. An inner angle of 90 degrees may exist between the connecting structure 25 and the feeding part 22 and between the connecting structure 25 and the grounding part 23. Additionally, the bending direction of the first separating slot 241*a* of the single band antenna 3 may be different from that of the first separating slot 241 of the single band antenna 2. Furthermore, the second separating part 242*a* may have two bends. This aspect is for example only. Sizes, lengths, or bending directions of the first and second separating slots 241*a* and 242*a*, and the connecting angles between the auxiliary part 27 and electrical structure connecting part 26, between the connecting structure 25 and feeding part 22, or between the connecting structure 25 and grounding part 23 may vary according to the design specification.

Figure 4:
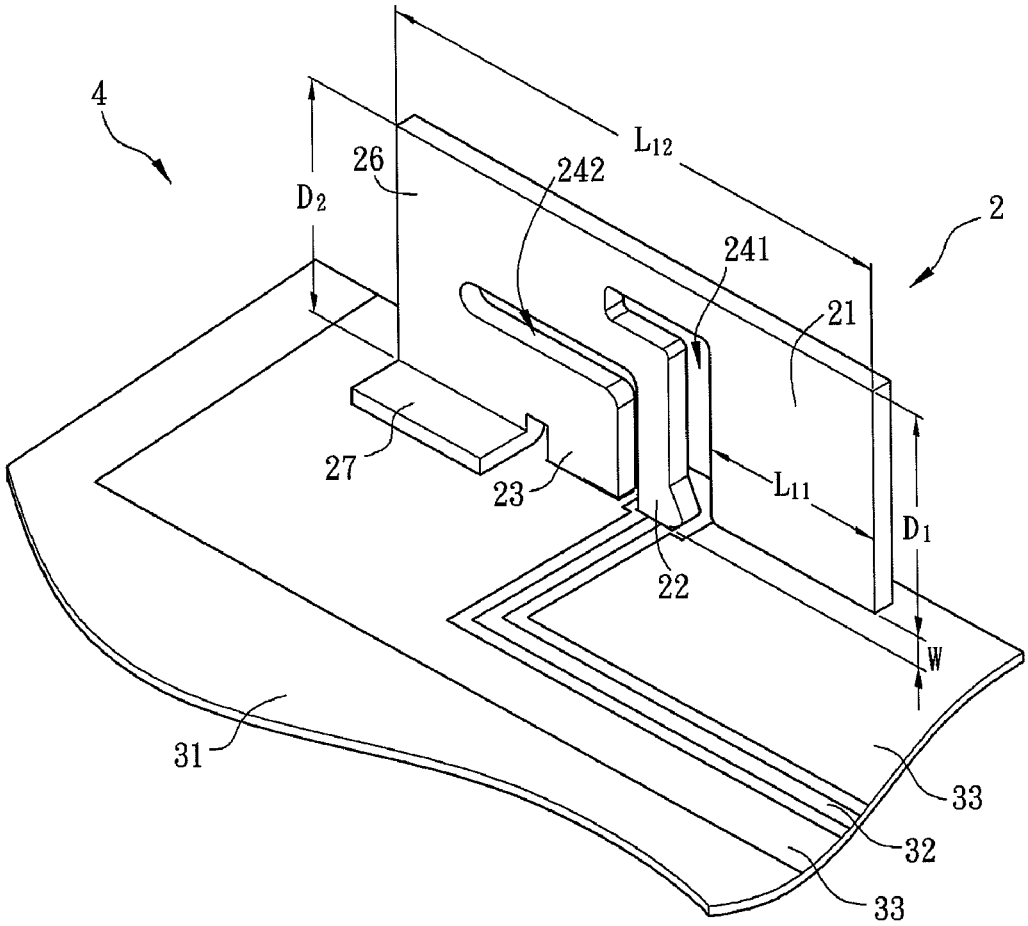
FIG. 4 is a schematic view of an antenna module according to a first embodiment of the present invention.

An antenna module of the preferred embodiment of the present invention will be illustrated with three examples as follows. Referring to FIG. 4, the antenna module 4 according to the first embodiment of the present invention includes a substrate 31 and a single band antenna 2.

The single band antenna 2 stands erect on the substrate 31. In the embodiment, the substrate 31 is a printed circuit board. The connecting structure 25 that connects the feeding part 22 with the grounding part 23 passes through the substrate 31, such that the single band antenna 2 is fixed on the substrate 31 so as to electrically connect the feeding part 22 with a wire 32 of the substrate 31. The grounding part 23 is electrically connected to a grounding surface 33 of the substrate 31. In the embodiment, the single band antenna 2 may be disposed on the substrate 31 by surface-mount technology (SMT).

The auxiliary part 27 and the electrical structure connecting part 26 are disposed perpendicularly to help the single band antenna 2 to stand erect on the substrate 31. The auxiliary part 27 may also be electrically connected to the grounding surface 33 of the substrate 31 for increasing the grounding area and stability of the structure. Furthermore, in the embodiment, the width D1 of the radiating part 21 is smaller than the width D2 of the electrical structure connecting part 26 and a gap W is between the radiating part 21 and the substrate 31 for preventing the radiating part 21 from connecting the grounding surface 33 electrically. In the embodiment, the frequency band of the antenna may be adjusted by changing the length L11 of the radiating part 21.

In addition, it is noted that in the single band antenna 2, features of the matching impedance may be adjusted by changing the size of the first separating slot 241 or second separating slot 242 and/or the width D1 of the radiating part 21. Furthermore, if the single band antenna 2 is applied at 2.4 GHz for example, the length L12 of the single antenna 2 is approximately 24 mm. Compared to a conventional antenna length of 45 mm, the size of the single band antenna 2 according to the preferred embodiment of the present invention is much smaller.

Figure 5:
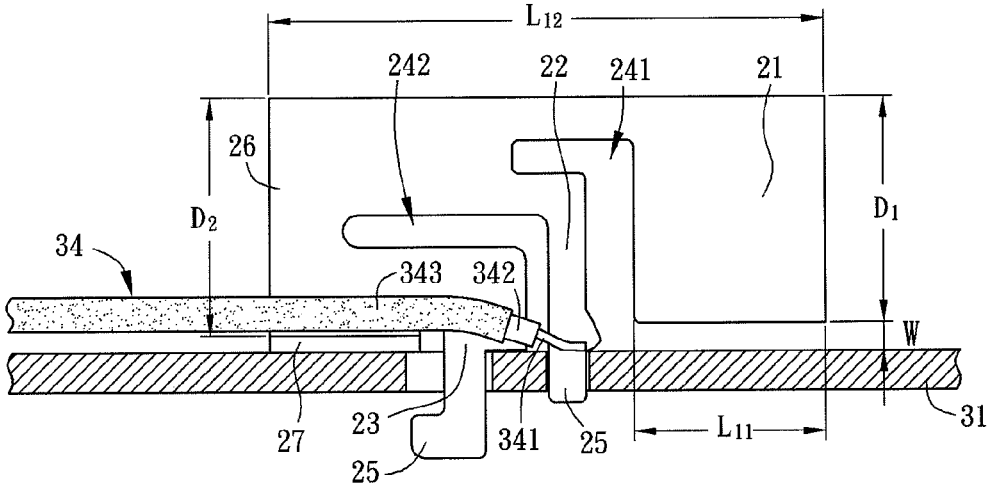
FIG. 5 is a cross-sectional view of the antenna module according to a first embodiment of the present invention.

FIG. 5 is a cross-sectional view of the antenna module 4 in FIG. 4. With reference to FIG. 5, the antenna module 4 further includes a conductive element 34 for feeding the signal into the antenna module 4. The conductive element 34 may be a coaxial transmission line. A conductive copper line 341 of the conductive element 34 is electrically connected to the feeding part 22, a grounding conductor 343 of the conductive element 34 is electrically connected to the grounding part 23, and an insulator 342 of the conductive element 34 is disposed between the conductive copper line 341 and the grounding conductor 343.

Figure 6:
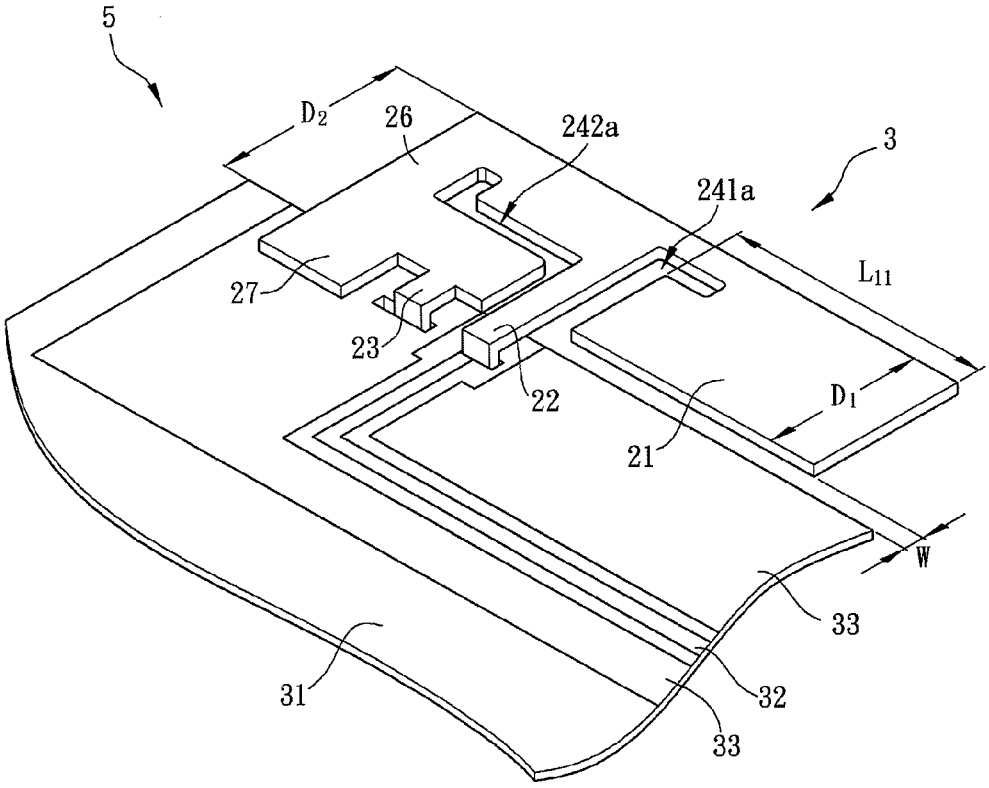
FIG. 6 is a schematic view of an antenna module according to a second embodiment of the present invention.

Referring to FIG. 6, the antenna 5 according to a second embodiment of the present invention includes a substrate 31 and a single band antenna 3.

The single antenna 3 is disposed on the substrate 31. In the embodiment, the substrate 31 is a printed circuit board. The connecting structure that connects the feeding part 22 with the grounding part 23 may be fixed onto the substrate 31 by soldering. The feeding part 22 is electrically connected to a wire 32 of the substrate 31 and the grounding part 23 is electrically connected to a grounding surface 33 of the substrate 31.

The inner angle between the auxiliary part 27 and the electrical structure connecting part 26 is 180 degrees. The auxiliary part 27 may also be fixed onto the substrate 31 by soldering and is electrically connected to the grounding surface 33 of the substrate 31. Additionally, in the embodiment, the width D1 of the radiating part 21 is smaller than the width D2 of the electrical structure connecting part 26 and a gap W exists between the radiating part 21 and the substrate 31 for preventing the radiating part 21 from connecting the grounding surface 33 electrically. Moreover, in the embodiment, the frequency band of the antenna may be adjusted by changing the length L11 of the radiating part 21.

Figure 7:
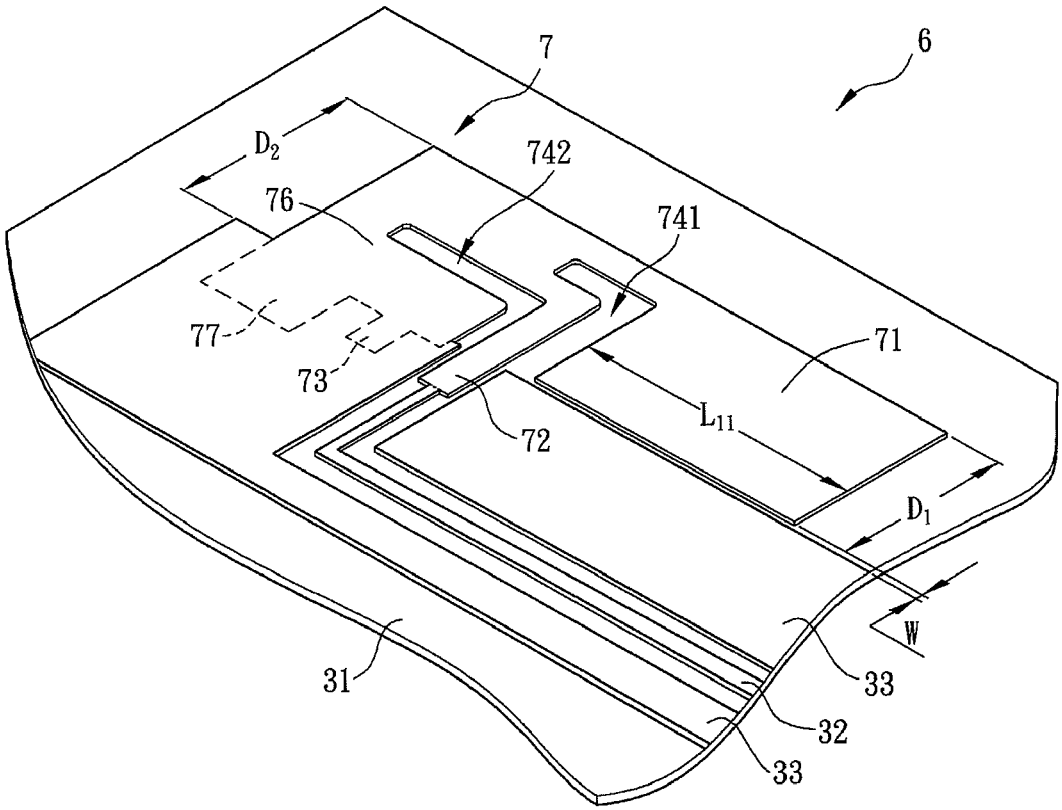
FIG. 7 is a schematic view of an antenna module according to a third embodiment of the present invention.

Please referring to FIG. 7, the antenna module 6 according to a third embodiment of the present invention includes a substrate 31 and a single band antenna 7, and the substrate 31 is a printed circuit board.

The single band antenna 7 includes a radiating part 71, a feeding part 72, a grounding part 73, an electrical structure connecting part 76 and an auxiliary part 77 that their structures and connections are substantially the same as those of the radiating part 21, feeding part 22, grounding part 23, electrical structure connecting part 26 and auxiliary part 27 of the above-described embodiment. Thus, a detailed description thereof will be omitted.

In the embodiment, the single band antenna 7 is integrated with the substrate 31. In other words, single band antenna 7 is integrally formed with the wire 32 and grounding surface 33 while manufacturing the substrate 31. In the embodiment, the feeding part 72 is electrically connected to a wire 32 of the substrate 31 and the grounding part 73 is electrically connected to a grounding surface 33 of the substrate 31.

The inner angle between the auxiliary part 77 and the electrical structure connecting part 76 is 180 degrees, and the auxiliary part 77 is electrically connected to the grounding surface 33 of the substrate 31. In addition, in the embodiment, the width D1 of the radiating part 71 is smaller than the width D2 of the electrical structure connecting part 76 and a gap W exists between the radiating part 71 and the grounding surface 33 of the substrate 31 for preventing the radiating part 71 from connecting the grounding surface 33 electrically. Furthermore, in the embodiment, the frequency band of the single band antenna 7 may be adjusted by changing the length L11 of the radiating part 71.

Figure 8:
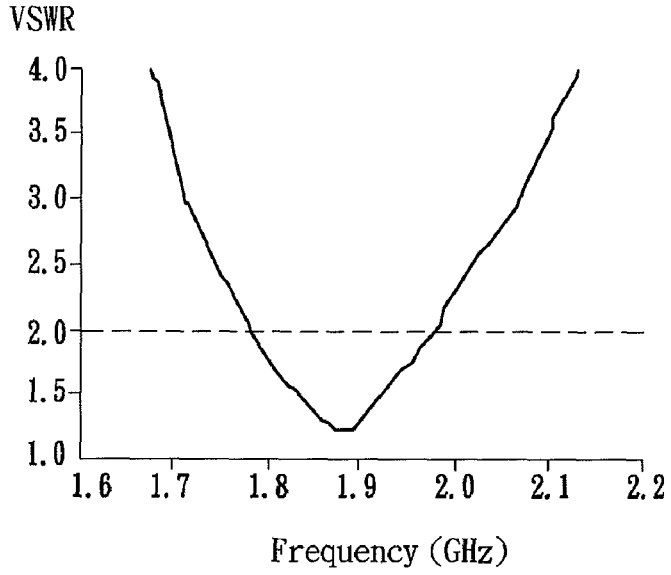
FIG. 8 is a voltage standing wave ratio (VSWR) measurement graph of the single band antenna used for DECT according to the preferred embodiment of the present invention.
Figure 9:
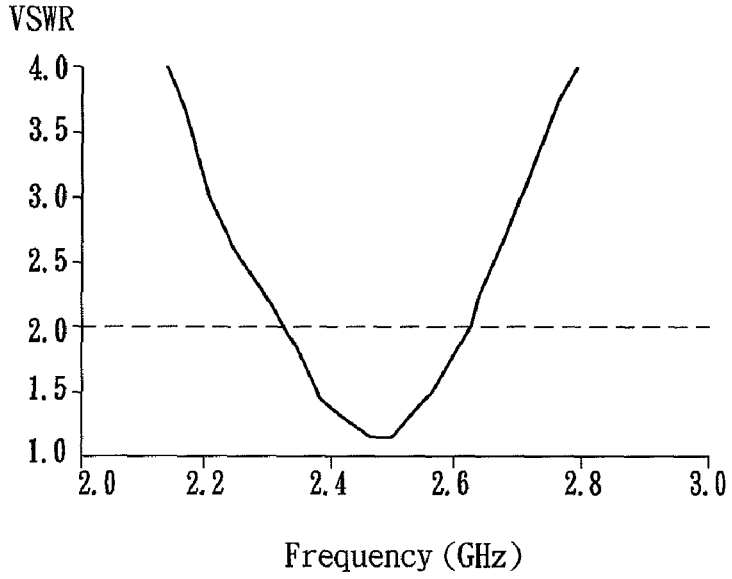
FIG. 9 is a VSWR measurement graph of the single band antenna used for WiFi according to the preferred embodiment of the present invention.

FIG. 8 is a voltage standing wave ratio (VSWR) measurement graph of the single band antenna used for DECT according to the above-mentioned embodiment and FIG. 9 is a VSWR measurement graph of the single band antenna used for WiFi according to the above-mentioned embodiment. With reference to FIGS. 8 and 9, the vertical axis represents VSWR and the horizontal axis represents frequency. The generally-accepted VSWR is approximately 2. If the VSWR is smaller than 2, the single band antenna will operate between 1.88 GHz and 1.9 GHz when the single band antenna applies on DECT and operate between 2.4 GHz and 2.5 GHz when applies on WiFi. Furthermore, only the length L11 of the radiating part has to be changed to use for frequency bands of different regulations, for example, WiFi, DECT, IEEE 802.11, WiMAX, respectively.

To sum up, in the single band antenna and the antenna module according to the present invention, the radiating part, feeding part, and grounding part are connected to one another and separated by the first and second separating slots. Each of the first separating slot and second separating slot has at least one bend, such that the path for signal oscillation can be extended and the size of antenna can be effectively reduced. The length of the radiating part is changed so that the antenna can be used for different frequency bands and suitably used in the small-sized electronics.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A single band antenna comprising:

a radiating part;

a feeding part connected to the radiating part, and a first separating slot between the radiating part and the feeding part, wherein the first separating slot has a first open segment, a first bend and a first closed segment, the first open segment is connected to the first closed segment through the first bend, two sides of the first open segment are parallel to each other and respectively adjacent to the radiating part and the feeding part, two sides of the first closed segment are parallel to each other and respectively adjacent to the radiating part and the feeding part; and a grounding part connected to the feeding part, and a second separating slot between the feeding part and the grounding part, wherein the second separating slot has a second open segment, a second bend and a second closed segment, the second open segment is connected to the second closed segment through the second bend, two sides of the second open segment are parallel to each other and respectively adjacent to the feeding part and the grounding part, two sides of the second closed segment are parallel to each other and respectively adjacent to the feeding part and the grounding part.

2. The single band antenna according to claim 1, wherein the radiating part, the feeding part and the grounding part are integrally formed.

3. The single band antenna according to claim 1, wherein the feeding part has a connecting structure connected to a substrate.

4. The single band antenna according to claim 1, wherein the grounding part has a connecting structure connected to a substrate.

5. The single band antenna according to claim 1, further comprising an electrical structure connecting part disposed between the grounding part and the feeding part.

6. The single band antenna according to claim 5, further comprising an auxiliary part connected to the electrical structure connecting part.

7. The single band antenna according to claim 6, wherein an included angle exists between the auxiliary part and the electrical structure connecting part.

8. The single band antenna according to claim 1, wherein sizes, lengths or, bending directions of the first separating slot and the second separating slot are the same or different.

9. An antenna module, comprising:

a substrate; and a single band antenna disposed on the substrate, comprising:

a radiating part, a feeding part connected to the radiating part, and a first separating slot between the radiating part and the feeding part, wherein the first separating slot has a first open segment, a first bend and a first closed segment, the first open segment is connected to the first closed segment through the first bend, two sides of the first open segment are parallel to each other and respectively adjacent to the radiating part and the feeding part, two sides of the first closed segment are parallel to each other and respectively adjacent to the radiating part and the feeding part, and a grounding part connected to the feeding part, and a second separating slot between the feeding part and the grounding part, wherein the second separating slot has a second open segment, a second bend and a second closed segment, the second open segment is connected to the second closed segment through the second bend, two sides of the second open segment are parallel to each other and respectively adjacent to the feeding part and the grounding part, two sides of the second closed segment are parallel to each other and respectively adjacent to the feeding part and the grounding part.

10. The antenna module according to claim 9, wherein the substrate is a printed circuit board.

11. The antenna module according to claim 9, wherein the feeding part has a connecting structure connected to the substrate.

12. The antenna module according to claim 9, wherein the grounding part has a connecting structure connected to the substrate.

13. The antenna module according to claim 9, wherein a gap is between the radiating part and the substrate.

14. The antenna module according to claim 9, wherein the single band antenna further comprises an electrical structure connecting part disposed between the grounding part and the feeding part.

15. The antenna module according to claim 14, wherein the single band antenna further comprises an auxiliary part connected to the electrical structure connecting part.

16. The antenna module according to claim 15, wherein an included angle exists between the auxiliary part and the electrical structure connecting part.

17. The antenna module according to claim 9, wherein sizes, lengths, or bending directions of the first separating slot and the second separating slot are the same or different.

18. The antenna module according to claim 9, further comprising a conductive element for connecting the feeding part with the grounding part.

19. The antenna module according to claim 18, wherein the conductive element is a coaxial transmission line.

* * * * *